US012371860B2

(12) United States Patent
Ganz

(10) Patent No.: US 12,371,860 B2
(45) Date of Patent: Jul. 29, 2025

(54) SYSTEM FOR SCREENING BALLAST WITH TWO SCREENS

(71) Applicant: MATISA Matériel Industriel S.A., Crissier (CH)

(72) Inventor: Jörg Ganz, Etoy (CH)

(73) Assignee: MATISA Matériel Industriel S.A., Crissier (CH)

( * ) Notice: Subject to any disclaimer, the term of this patent is extended or adjusted under 35 U.S.C. 154(b) by 837 days.

(21) Appl. No.: 17/620,656

(22) PCT Filed: Jun. 18, 2020

(86) PCT No.: PCT/EP2020/067011
§ 371 (c)(1),
(2) Date: Dec. 17, 2021

(87) PCT Pub. No.: WO2020/254520
PCT Pub. Date: Dec. 24, 2020

(65) Prior Publication Data

US 2022/0412016 A1 Dec. 29, 2022

(30) Foreign Application Priority Data

Jun. 18, 2019 (FR) ..... 1906560

(51) Int. Cl.
*E01B 27/10* (2006.01)

(52) U.S. Cl.
CPC ..... *E01B 27/10* (2013.01); *E01B 2203/032* (2013.01); *E01B 2203/045* (2013.01); *E01B 2203/065* (2013.01)

(58) Field of Classification Search
CPC ..... E01B 27/10; E01B 2203/032; E01B 2203/045; E01B 2203/065
See application file for complete search history.

(56) References Cited

U.S. PATENT DOCUMENTS 4,534,415 A * 8/1985 Theurer ..... E01B 27/105 171/16
4,614,238 A * 9/1986 Theurer ..... E01B 27/105 104/2

(Continued)

FOREIGN PATENT DOCUMENTS

DE 20 2007 011 501 U1 12/2008
EP 0059500 B1 * 10/1984

(Continued)

OTHER PUBLICATIONS

EP 0059500 B1—English translation (Year: 1984).*

(Continued)

*Primary Examiner* — Matthew Troutman
*Assistant Examiner* — Julia C Tran
(74) *Attorney, Agent, or Firm* — Chiesa Shahinian & Giantomasi PC

(57) ABSTRACT

A system (10) for sieving ballast comprises a first sieve (26) and a second sieve (28) which is located behind the first sieve (26) in a first direction (100). A discharge collection conveyor (32.1) is located directly under a first discarded ballast outlet (42) of the first sieve (26) in order to collect a flow of discarded ballast which comes from the first sieve (26) and to convey it in a second direction (200) counter to the first direction (100). A rerouting collection conveyor directly collects the flow being discharged from a clean ballast outlet of the second sieve in order to convey it in the first direction (100). The rerouting collection conveyor extends under the first sieve (26) at a lower height than the discharge collection conveyor.

20 Claims, 2 Drawing Sheets

(56) References Cited

U.S. PATENT DOCUMENTS

| | | | | | |
|---|---|---|---|---|---|
| 4,640,364 | A | * | 2/1987 | Theurer | E01B 27/105 171/126 |
| 4,813,488 | A | * | 3/1989 | Theurer | E01B 27/10 171/16 |
| 4,967,847 | A | * | 11/1990 | Whitaker, Jr. | E01B 27/10 37/107 |
| 5,090,483 | A | * | 2/1992 | Theurer | E01B 27/026 37/104 |
| 5,090,484 | A | * | 2/1992 | Theurer | E01B 27/026 104/2 |
| 5,109,775 | A | * | 5/1992 | Kershaw | E01B 27/10 104/2 |

FOREIGN PATENT DOCUMENTS

| | | |
|---|---|---|
| GB | 2 127 467 A | 4/1984 |
| WO | WO 2017/158500 A1 | 9/2017 |

OTHER PUBLICATIONS

International Search Report and Written Opinion mailed Oct. 2, 2020 in corresponding International Application No. PCT/EP2020/067011 and the English Translation of the International Search Report.

* cited by examiner

SYSTEM FOR SCREENING BALLAST WITH TWO SCREENS

CROSS-REFERENCE TO RELATED APPLICATIONS

This application is the National Stage entry under 35 U.S.C. § 371 of International Application No. PCT/EP2020/067011, filed Jun. 18, 2020, published on Dec. 24, 2020 under Publication Number WO 2020/254520 A1, which claims the benefit of priority under 35 U.S.C. § 119 of French Patent Application Number FR1906560, filed Jun. 18, 2019, the entireties of which are herein incorporated by reference.

TECHNICAL FIELD OF THE INVENTION

The invention relates to a system for sieving ballast designed to sort soiled ballast and integrated into a mobile ballast bed repair system.

STATE OF THE PRIOR ART

Mobile ballast bed repair systems are well known. The operating principle uses at least one excavation system to recover the soiled ballast with or without raising the rails, and a conveyor assembly, which conveys the soiled ballast to at least one sieve. The sieve has the effect of dividing the soiled flow of ballast into a flow of clean ballast and a flow of discarded ballast. The flow of clean ballast is then preferably conveyed by a conveyor assembly to a system for relining the track, or failing this to a container or wagon for storing clean ballast, while the flow of discarded ballast is conveyed by a conveyor assembly to a container or wagon for storing discarded ballast. These mobile systems are complex and imposing, with ballast flows that are conveyed on conveyor belts or other conveyors which are liable to cross each other in length and height and which contribute to a large footprint. Furthermore, the treatment capacity of the sieve, in terms of the flow of soiled ballast treated, varies with the quality of the soiled ballast. In order not to slow down the advance of the machine advancing on a very soiled ballast bed, it is necessary either to have a large capacity sieve, or to be satisfied with a lower sieving quality, or to sieve only part of the soiled ballast, the remainder being transported directly to a storage wagon without sieving.

Document EP 0,408,837 describes a ballast repair machine comprising two excavation systems and two sieves that are remote from one another. One sieve is used to clean a surface layer of track ballast, while the other sieve is dedicated to cleaning a deeper layer of track ballast. Each excavation system feeds a sieve with an independent flow of soiled ballast. Each sieve produces a flow of clean ballast and a flow of discarded ballast. The two flows of clean ballast are re-routed independently of one another to the track, at two points of the machine that are far apart from each other. The flow of discarded ballast from the sieve farthest from the discarded ballast storage car is transported by a conveyor assembly to the nearest sieve and directly joins the ballast flow from the nearest sieve.

This arrangement allows the discarded ballast to be collected toward a single storage point and using the conveyor assembly for the ballast discarded by the flows of the two sieves allows the routing of the flows to be simplified. However, it is not envisioned to operate only one of the two sieves, or to convey the soiled ballast directly to a storage wagon without going through the sieves, for full excavation. The use of the machine is therefore not flexible.

Document EP 0,240,648 describes a ballast repair machine comprising a single excavation system, the flow of soiled ballast of which feeds two sieves in parallel. The two sieves are installed such that the flows of clean ballast leaving each of the sieves open at the same location and the resulting flow of clean ballast is conveyed by a conveyor assembly to the relining system. Supplying soiled ballast to each of the sieves requires distributing the flow of soiled ballast by a set of conveyors, each sieve having its own conveyor. The flows of discarded ballast leaving the sieves are recovered by a conveyor assembly and the resulting flow of discarded ballast is conveyed to the storage wagon.

This arrangement of two contiguous sieves makes it possible to simplify the conveyor assemblies of the various flows of discarded and clean ballast. However, arranging the sieves in opposition, that is to say, with their soiled ballast inlets at two opposite ends spaced apart from one another and their clean ballast outlets contiguous, makes their supply of soiled ballast flows complex, with a division of the soiled ballast flow into two flows moving in different directions, which does not make it possible to easily envisage a usage mode for total excavation in which the soiled ballast flow would be diverted directly toward a storage wagon without going through the two sieves.

Document WO2014080122A1 describes a ballast repair machine comprising an excavation system, the flow of soiled ballast of which feeds two sieves in parallel. The two sieves are arranged end to end such that their soiled ballast inlets are directly adjacent and that the flows of clean ballast at the outlet of each of the sieves open out at opposite ends of the two sieves. The discarded ballast is collected by a conveyor located directly under the two sieves, which can convey the discarded ballast as needed to either end of the work train. This conveyor must have a large capacity, since it collects the discarded ballast from the two sieves. The clean ballast is collected by a rerouting conveyor positioned under the discarded ballast conveyor. There is therefore a crossing between a large-capacity discarded ballast conveyor and a clean ballast rerouting conveyor, which increases the size in the width direction of the machine. Arranging the sieves with their soiled ballast inlets contiguous makes it possible to envisage a usage mode for total excavation, in which the flow of soiled ballast would be diverted directly to a storage wagon without passing through the two sieves. However, there are no plans to modulate the distribution of the soiled ballast between the two sieves.

Document FR 2539156 describes a ballast repair machine also comprising an excavation system and two sieves. The sieves are arranged one after the other and a set of conveyors distributes the flow of soiled ballast between the two sieves. A set of conveyors collects the flows of discarded ballast from the two sieves to convey it, in the opposite direction from that of the supply conveyors, to a storage wagon. The flows of clean ballast are routed to two separate release systems. Arranging these two sieves in the same direction makes it possible to simplify the supply of the sieves by the flow of soiled ballast, but does not provide for a single flow of clean ballast, such that the relining operation becomes more complex.

In DE 20 2007 011501 U1, a ballast sieving system according to the preamble of claim 1 is described.

DISCLOSURE OF THE INVENTION

The invention aims to remedy the drawbacks of the state of the art and to make a mobile ballast sieving system that is simpler and more flexible in its use.

To do this, according to a first aspect of the invention, a ballast sieving system is proposed that is capable of moving parallel to a working direction, comprising

- a sieving installation comprising at least a first sieve having a first soiled ballast inlet, a first clean ballast outlet which is located in front of the first soiled ballast inlet in a first direction parallel to the working direction and a first discarded ballast outlet, and at least one second sieve having a second soiled ballast inlet which is located behind the first soiled ballast inlet in the first direction, a second clean ballast outlet which is located behind the first clean ballast outlet and in front of the second soiled ballast inlet in the first direction and a second discarded ballast outlet,
- a set of one or more discharge conveyors capable of collecting and conveying, in a second direction parallel to the working direction and opposite the first direction, a flow of discarded ballast from the first discarded ballast outlet and a flow of discarded ballast from the second discarded ballast outlet, the set of one or more discharge conveyors comprising one or more first discharge collection conveyors, located directly below the first discarded ballast outlet to collect a flow of discarded ballast from the first sieve and to convey it in the second direction,
- a set of one or more rerouting conveyors capable of collecting and conveying, in the first direction, a flow leaving the second clean ballast outlet and a flow leaving the first clean ballast outlet, the set of one or more rerouting conveyors comprising one or more rerouting collection conveyors for directly collecting the flow leaving the second clean ballast outlet and conveying it in the first direction, the rerouting collection conveyor(s) extending under the first sieve at a lower height than the first discharge collection conveyor(s).

The first discarded ballast outlet is located, with reference to the working direction, between the first clean ballast outlet and the second clean ballast outlet. The area of the mobile sieving system in which the rerouting and discharge flows are superimposed in the working direction has a short length, since it corresponds only to the area where the first sieve is located.

The first discharge collection conveyor(s) are intended to convey only the discarded ballast from the first sieve, and do not need to be dimensioned to convey all of the discarded ballast flow rates corresponding to both sieves. Thus, the flow of discarded ballast conveyed into the overlap area, under the first sieve, has a low flow rate relative to the total capacity of the system. It is therefore possible, if necessary, to minimize the motor means or the width of the first discharge collection conveyor, which facilitates its installation in the limited space available under the first sieve.

Similarly, the part of the rerouting collection conveyor(s) located under the first sieve to convey only the cleaned ballast from the second sieve does not need to be dimensioned to convey all of the clean ballast flow rates corresponding to both sieves. Thus, the flow of clean ballast conveyed into the overlap area, under the first sieve, has a low flow rate compared to the total capacity of the system. It is therefore possible, if necessary, to minimize the motor means or the width of a first rerouting collection conveyor of the set of one or more rerouting collection conveyors, if this facilitates its installation in the limited space available under the first sieve. Alternatively, it is also possible to provide for the set of rerouting conveyors to comprise a single conveyor, which constitutes the rerouting collection conveyor for both sieves.

The second sieve comprises a discarded ballast inlet suitable for being supplied by the first discharge collection conveyor(s), and a spout for passing the flow of discarded ballast coming from the first sieve from the discarded ballast inlet to the second discarded ballast outlet. The second sieve is configured to pass the discarded ballast from the discarded ballast inlet to the second discarded ballast outlet, so that the discarded ballast from the first sieve and the second sieve is collected by a second discharge collection conveyor located directly under the second discarded ballast outlet. This second discharge collection conveyor must have sufficient capacity to convey all of the flows of discarded ballast generated by both sieves. It therefore, where appropriate, has larger dimensions (in particular in terms of width) than the first discharge collection conveyor and/or more powerful motor means.

Preferably, the discarded ballast inlet of the second sieve is positioned above the second clean ballast outlet. A particularly compact system is thus obtained.

According to one embodiment, the second sieve and the first sieve overlap. In particular, the second clean ballast outlet can advantageously be placed under the first sieve, in particular under a part of the first sieve comprising the first soiled ballast inlet, which makes it possible to reduce the distance between the soiled ballast inlets, the distance between the discarded ballast outlets, and the distance between the clean ballast outlets.

According to one embodiment, the set of one or more rerouting conveyors comprises at least one common rerouting conveyor capable of conveying both the flow of clean ballast from the second clean ballast outlet and the flow of clean ballast from the first clean ballast outlet, in the first direction, at least part of the common rerouting conveyor preferably being positioned under the first sieve. The routes of the soiled, discarded and clean ballasts are therefore drastically simplified and, by the same token, the organization of the sets of rerouting and discharge conveyors are as well. Optionally, the rerouting conveyor may become one with the rerouting collection conveyor from the clean ballast outlet of the second sieve, and extend under the first sieve. Alternatively, it may be a separate conveyor, into which the rerouting collection conveyor from the clean ballast outlet of the second sieve is able to discharge.

The flows are simplified owing to the existence and the orientation of the common rerouting conveyor.

Preferably, the mobile ballast sieving system comprises an assembly for relining or storing clean ballast, supplied by the set of one or more rerouting conveyors, the assembly for relining or storing clean ballast being positioned preferably in front of the first soiled ballast inlet, and preferably in front of the first sieve, in the first direction.

Preferably, the mobile ballast sieving system comprises a discarded ballast storage assembly, the set of one or more discharge conveyors comprising at least one common discharge conveyor capable of conveying both the flow of discarded ballast from the first discarded ballast outlet and the flow of discarded ballast from the second discarded ballast outlet to the discarded ballast storage assembly, in the second direction, at least part of the common discharge conveyor preferably being positioned under the second sieve. By providing a common discharge conveyor and orienting it in the direction opposite the rerouting conveyor, a crossing of the sets of conveyors is avoided, thereby further simplifying the system.

According to one embodiment, the mobile ballast sieving system comprises an excavation assembly, and a set of one or more excavation conveyors, capable of transferring soiled ballast from the excavation assembly to the first distributor while constituting the incident soiled ballast flow. Preferably, the first soiled ballast inlet is positioned between the excavation assembly and the second soiled ballast inlet, and, preferably, the first sieve is positioned between the excavation assembly and the second soiled ballast inlet. Particularly advantageously, provision can be made for the assembly for relining or for storing clean ballast to be positioned between the excavation assembly and the first soiled ballast inlet, and preferably between the excavation assembly and the first sieve.

The conveyors of the various sets of conveyors can be of any type, with a continuous belt, chain or conveyor belt or any other material transport device, for example with buckets.

The sieves can be of any type. They preferably use vibrating sieves, and take advantage of gravity in the process of transferring the massive elements of soiled ballast from the inlet to the clean ballast outlet, so that the clean ballast outlets and the discarded ballast outlets are lower than the soiled ballast inlets.

To diversify the operating modes authorized by the system and to allow it to adapt to different external working conditions, at least one first distributor can be provided that is capable of distributing an incident soiled ballast flow between the first soiled ballast inlet and the second soiled ballast inlet, preferably according to one, two or three of the following operating modes:

- a distribution operating mode, in which the first distributor is able to distribute the incident soiled ballast flow between the first soiled ballast inlet and the second soiled ballast inlet;
- a return operating mode to the second sieve, in which the first distributor is able to direct the incident soiled ballast flow entirely toward the second soiled ballast inlet;
- a return operating mode to the first sieve, in which the first distributor is able to direct the incident soiled ballast flow entirely toward the first soiled ballast inlet.

According to a particularly advantageous embodiment, there is further provided a second distributor interposed between the first distributor and the second soiled ballast inlet that is capable, in at least one operating mode of the second distributor, of directing a flow of soiled ballast coming from the first distributor toward the second soiled ballast inlet and, in a second operating mode of the second distributor, of directing the flow of soiled ballast from the first distributor toward a conveyor of the set of one or more discharge conveyors. The conjunction of the first distributor and the second distributor makes it possible to envisage different operating modes, the two sieves being able, if necessary, to operate in parallel or alternately, depending on the positioning of the first sieve, the second distributor making it possible to implement an operating mode in which all or part of the incident soiled ballast flow is directed by the first distributor toward the second distributor and by the latter toward a discharge conveyor, without passing through either the first or the second sieve.

In one embodiment, the mobile sieving system may comprise a third sieve having a third soiled ballast inlet and a third discarded ballast inlet, a third clean ballast outlet and a third discarded ballast outlet. A third distributor is then interposed between the second distributor and the third soiled ballast inlet that is capable, in at least one operating mode, of directing a flow of soiled ballast toward the third soiled ballast inlet and, in another operating mode, of directing the flow of soiled ballast toward a conveyor of the set of one or more discharge conveyors. It is thus possible to increase the sieving capacity of the system and to vary the number of operating modes, in order to adapt to the usage conditions.

According to another aspect of the invention, it relates to a ballast sieving system, which comprises a first sieve and a second sieve located behind the first sieve in a reference direction. A first distributor makes it possible to distribute an incident soiled ballast flow between the first sieve and the second sieve. At least one common rerouting conveyor allows a flow of clean ballast from the second sieve and the first sieve to be conveyed in the reference direction. A second distributor is interposed between the first distributor and the second sieve to direct a flow of soiled ballast from the first distributor selectively to the second sieve or to a discharge conveyor.

BRIEF DESCRIPTION OF THE FIGURES

Other features and advantages of the invention will emerge on reading the following description, with reference to the appended figures, which illustrate.

For greater clarity, identical or similar elements are identified by identical reference signs in all of the figures.

DETAILED DESCRIPTION OF EMBODIMENTS

Figure 1:
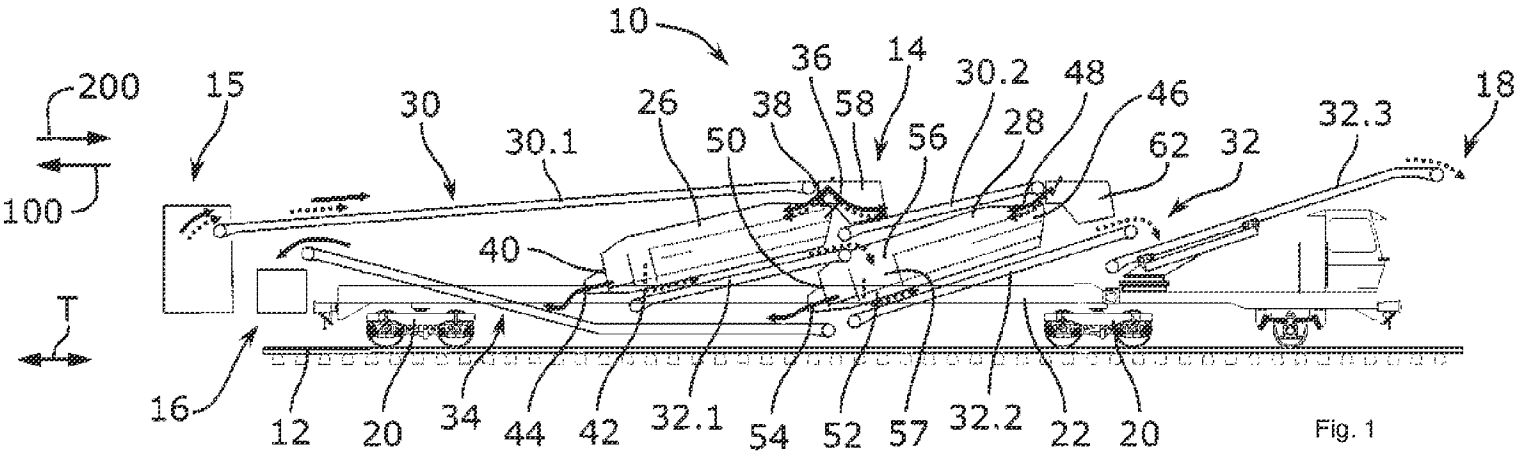
FIG. 1, a railway works vehicle comprising a ballast sieving installation according to one embodiment of the invention, in an operating mode with two sieves operating in parallel.

FIG. 1 shows a mobile system 10 for repairing a ballast bed capable of moving on a railway track 12 being repaired, parallel to a working direction T. The mobile system 10 is composed of a wagon 22 bearing a sieving installation 14, located between, on the one hand, an excavation assembly 15 and a relining assembly 16 and, on the other hand, a discarded ballast storage assembly 18. For the remainder of the description and arbitrarily, the following will be defined: a first direction 100 parallel to the working direction T and going from the sieving installation to the relining assembly 16 and the excavation assembly 15, and a second direction 200 parallel to the working direction T and opposite the first direction. The relining assembly 16 is preferably located between the excavation assembly 15 and the sieving installation 14. The first direction 100 is therefore a privileged direction of movement of the mobile system 10, at least in the operating modes during which relining is envisaged, insofar as the relining operations carried out by the relining assembly 16 are intended to be carried out after the excavation operations carried out by the excavation assembly 15. The excavation assembly 15, the relining assembly 16 and the storage assembly 18 are shown here only schematically, and can be borne by the same wagon as the sieving installation or by vehicles coupled or not coupled to the wagon of the sieving installation.

The wagon 22 bearing the sieving installation 14 here comprises two bogies 20 on which a frame rests that bears the various elements of the sieving installation 14.

The sieving installation 14, which comprises two sieves 26 and 28, is supplied by a set of one or more excavation conveyors 30, here conveyor belts, conveying soiled ballast coming from the excavation assembly 15, in the second direction 200. A set of one or more discharge conveyors 32 conveys the flow of discarded ballast, after passing through the sieves, in the second direction 200, to the discarded ballast storage assembly 18. A set of one or more relining conveyors 34 collects the flows of clean ballast after passing through the sieves, and conveys them to the relining assembly 16, in the first direction 100. The assembly of one or more relining conveyors 34 is preferably arranged under the assembly of one or more excavation conveyors 30, without crossing in the vertical direction.

The first sieve 26 has a first soiled ballast inlet 38 at a first end 36 and, at a second end 40, located below and in front of the first end 36 in the first direction 100, a first discarded ballast outlet 42 and a first clean ballast outlet 44.

The second sieve has a second soiled ballast inlet 48 at a first end 46 and, at a second end 50, located below and in front of the first end 46 in the first direction 100, a second discarded ballast outlet 52, a second clean ballast outlet 54 and a secondary discarded ballast inlet 56. The secondary discarded ballast inlet 56 is located above the second discarded ballast outlet 52 of the second sieve.

The internal workings of the sieves 26, 28, known per se, allows the finer components of the soiled ballast to pass through vibrating sieves and to be directed to the discarded ballast outlet 42, 52, while the components retained by the sieves are directed toward the clean ballast outlet 44, 54. The passage through the sieves involves gravity as well as a vibratory movement of the sieves. Where appropriate, the discarded ballast outlets 42, 52 may not be located, or may not be located only, at the lower end of the sieves 26, 28, but may instead extend over all or part of the length of the sieves 26, 28. In practice, the thinnest discarded elements are discarded along the entire length of the sieve, while the larger gauge discarded elements travel to the lower end of the sieve.

The two sieves 26, 28 overlap, in the sense where part of the first sieve, in this case the part comprising the first end 36 and the first soiled ballast inlet, is arranged above a part of the second sieve 28, in this case the end part 50 comprising the second clean ballast outlet 54. This makes it possible to reduce the distance between the inlets of each of the sieves 26, 28 as well as the distance between the outlets of each of the sieves 26, 28.

A first distributor 58, positioned between a conveyor 30.1 of the set of one or more soiled ballast conveyors 30 and the first soiled ballast inlet 38 of the first sieve, is able, in a so-called distribution operating mode, to divide a soiled ballast flow between the first sieve 26 and the second sieve 28, or in a first orientation operating mode, to direct the entire soiled ballast flow toward the first sieve 26 or in a second orientation operating mode, to direct the entire soiled ballast flow toward the second sieve 28. It preferably has more intermediate positions to modulate the division ratio of the flow of soiled ballast between the two sieves, discretely or continuously.

The set of excavation conveyors 30 comprises an intermediate conveyor 30.2 positioned between the first distributor 58 and the second sieve 28 in order to convey the flow of soiled ballast directed toward the second sieve 28 at the outlet of the first distributor 58.

A second distributor 62, positioned between the intermediate conveyor 30.2 and the second soiled ballast inlet 48 of the second sieve 28, is suitable, in a first operating mode, for guiding the flow of soiled ballast toward the second soiled ballast inlet 48 of the second sieve or, in another operating mode, for directing the flow of soiled ballast toward a conveyor 32.2 of the set of at least one discharge conveyor 32. This second distributor 62 can, if necessary, have only two positions, if it is not envisaged to divide the incoming flow of soiled ballast in two. Alternatively, and according to a preferred embodiment, the second distributor 62 allows a continuous adjustment to divide the flow of soiled ballast between the second sieve 28 and the set of discharge conveyors 32, which makes it possible, if necessary, to work the second sieve 28 while removing excess soiled ballast exceeding the sieving capacities or requirements.

The discharge conveyor assembly 32 comprises a first discharge collection conveyor 32.1, positioned under the first discarded ballast outlet 42 of the first sieve and extending to the second secondary inlet 56 of the second sieve, in order to collect the flow of ballast from the first discarded ballast outlet 42 of the first sieve 26 and to convey it to the second sieve 28. The second sieve is equipped with a spout 57 that connects the second secondary inlet 56 to the second discarded ballast outlet 52 while allowing crossing with the second clean ballast outlet 54, inside the second sieve 28. The two discarded ballast flows coming from the first sieve 26 and from the second sieve 28 are thus collected at the second discarded ballast outlet 52 of the second sieve 28 by a second discharge collection conveyor 32.2 of the set of discharge conveyors 32. The set of discharge conveyors 32 further comprises a conveyor 32.3 into which the discarded ballast flow from the conveyor 32.2 is discharged, and which transfers the flow of discarded ballast to the discarded ballast storage assembly 18.

As illustrated in the figures, the conveyors 30.1, 30.2 of the set of excavation conveyors are positioned above the sieves 26, 28, which in turn are positioned above the conveyor(s) of the set of rerouting conveyors 34. The intermediate discharge conveyor 32.1 is positioned, in terms of height, midway between the set of excavation conveyors 30 and the set of rerouting conveyors 34.

FIGS. 1 to 4 illustrate a conveyor 30.1 that conveys a flow of soiled ballast from the excavation assembly 15 to the first distributor 58.

In FIG. 1, the first distributor 58 is illustrated in a distribution operating mode and the flow of soiled ballast is distributed between the first sieve 26 and the intermediate conveyor 30.2, which conveys a partial flow of soiled ballast to the second distributor 62. The second distributor 62 is in a first orientation operating mode, and directs the flow of soiled ballast entirely toward the second sieve 28.

The flows of soiled ballast pass through the sieves 26, 28 and the flows of clean ballast and discarded ballast are collected. The set of one or more rerouting conveyors 34, working in the first direction 100, collects the flow of clean ballast coming from the second clean ballast outlet 54 of the second sieve 28, then the flow of clean ballast coming from the first clean ballast outlet 44 of the first sieve 26, and thus conveys a single flow of clean ballast in the first direction to the relining assembly 16, which ensures relining of the track, that is to say, spreading of the clean ballast on a bare portion of the track.

The flow of discarded ballast coming from the first discarded ballast outlet 42 of the first sieve 26 is collected by the intermediate conveyor 32.1 and discharged into the second sieve 28, at the second secondary discarded ballast inlet 56 of the second sieve so as not to put unnecessary strain on the sieves of the second sieve 28. The flow of discarded ballast from the second discarded ballast outlet 52, coming from the first and second sieves 26, 28, is collected by the set of one or more discharge conveyors 32, which works in the same direction as the excavation conveyor 30, that is to say, in the second direction 200, toward the discarded ballast storage assembly 18.

Figure 2:
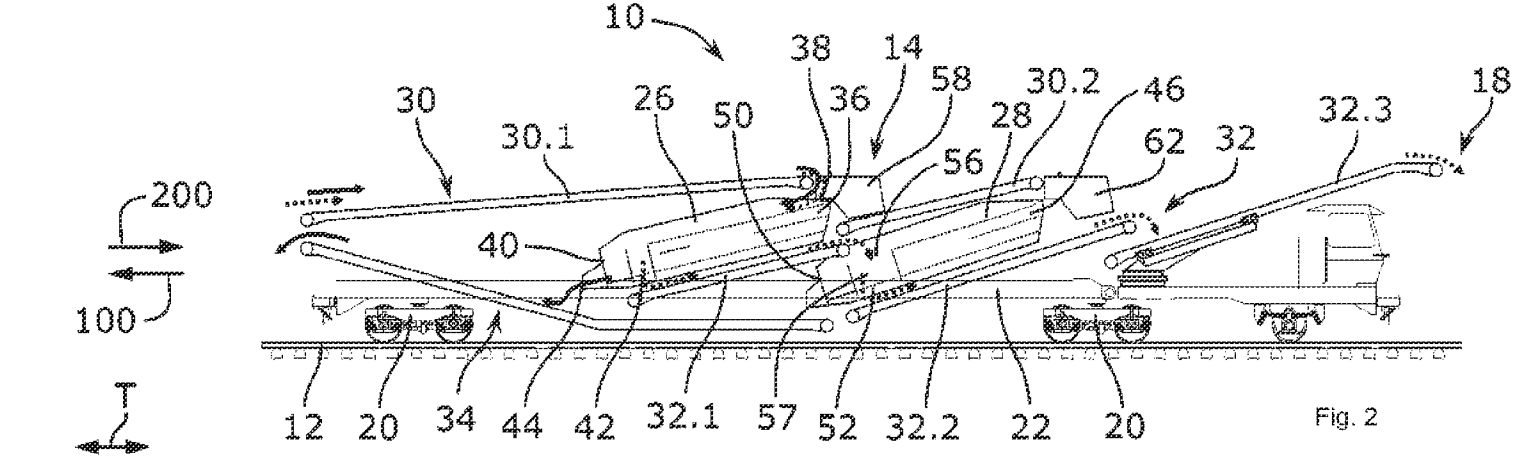
FIG. 2, the railway works vehicle of FIG. 1, the sieving installation of which operates in a mode where only a first of the two sieves is in operation.

In FIG. 2, the first distributor 58 is illustrated in a first orientation operating mode, and directs the flow of soiled ballast entirely toward the first soiled ballast inlet 38 first sieve 26. The intermediate conveyor 30.2, the second distributor 62 and the second sieve 28 are inoperative.

The flow of soiled ballast passes through the first sieve 26 and the flows of clean ballast and discarded ballast are collected. The set of one or more rerouting conveyors 34 collects the flow of clean ballast from the first clean ballast outlet 44 of the first sieve, and thus conveys only the flow of clean ballast, in the first direction 100, to the relining assembly 16.

The flow of discarded ballast coming from the first discarded ballast outlet 42 of the first sieve 26 and collected by the intermediate conveyor 32.1 is discharged into the second sieve 28, at the second secondary discarded ballast inlet 56 of the second sieve. The flow of discarded ballast from the second discarded ballast outlet 52, coming from the second sieve 28, is collected by a common conveyor 32.2 of the set of one or more discharge conveyors 32, which works in the same direction as the excavation conveyor 30, that is to say, in the second direction 200, toward the storage assembly 18.

Figure 3:
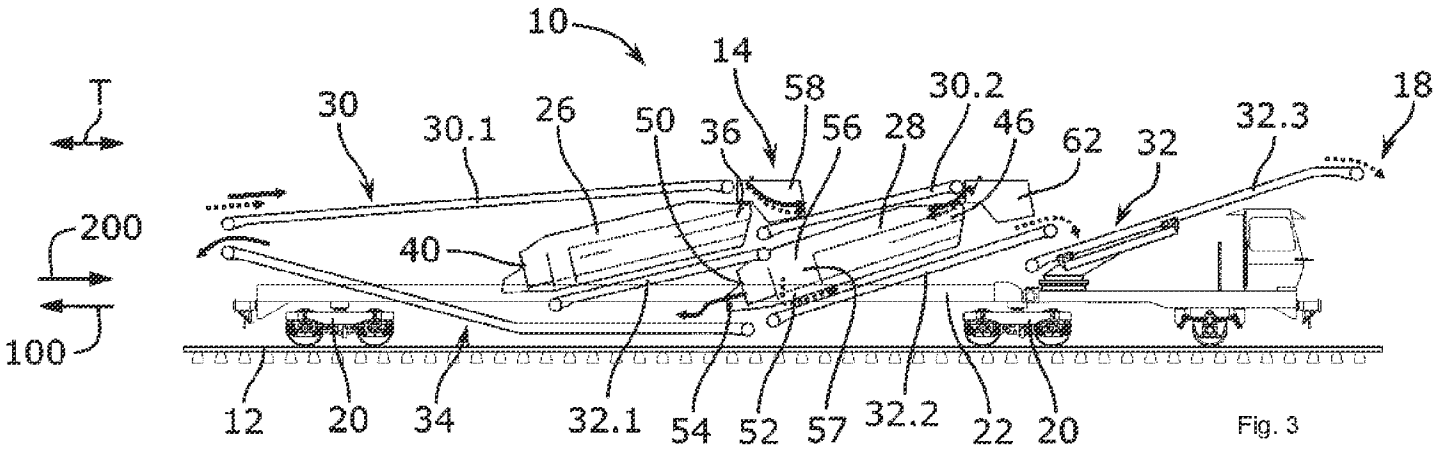
FIG. 3, the railway works vehicle of FIG. 1, the sieving installation of which operates in a mode in which only a second of the two sieves is in operation.

In FIG. 3, the first distributor 58 is illustrated in a second orientation operating mode and the flow of soiled ballast is oriented entirely toward the intermediate conveyor 30.2, which conveys the entire flow of soiled ballast toward the second distributor 62, while the first sieve 26 is inoperative.

The second distributor 62 directs the flow of soiled ballast toward the second soiled ballast inlet of the second sieve 28. The flow of soiled ballast passes through the second sieve and the clean ballast and discarded ballast flows are collected. The set of one or more rerouting conveyors 34 working in the first direction 100 collects the flow of clean ballast from the second clean ballast outlet 54 of the second sieve, and thus conveys only the flow of clean ballast to the second relining assembly 16.

The flow of discarded ballast from the second discarded ballast outlet 52 of the second sieve 28 is collected by the set of one or more discharge conveyors 32, which works in the same direction as the excavation conveyor 30, that is to say, in the second direction 200, and conveyed toward the storage assembly 18.

The sieving installation according to the invention therefore allows various sieving modes in which one or the other of the two sieves 26, 28, or both, are used. The sieving throughput can therefore be doubled when necessary.

Figure 4:
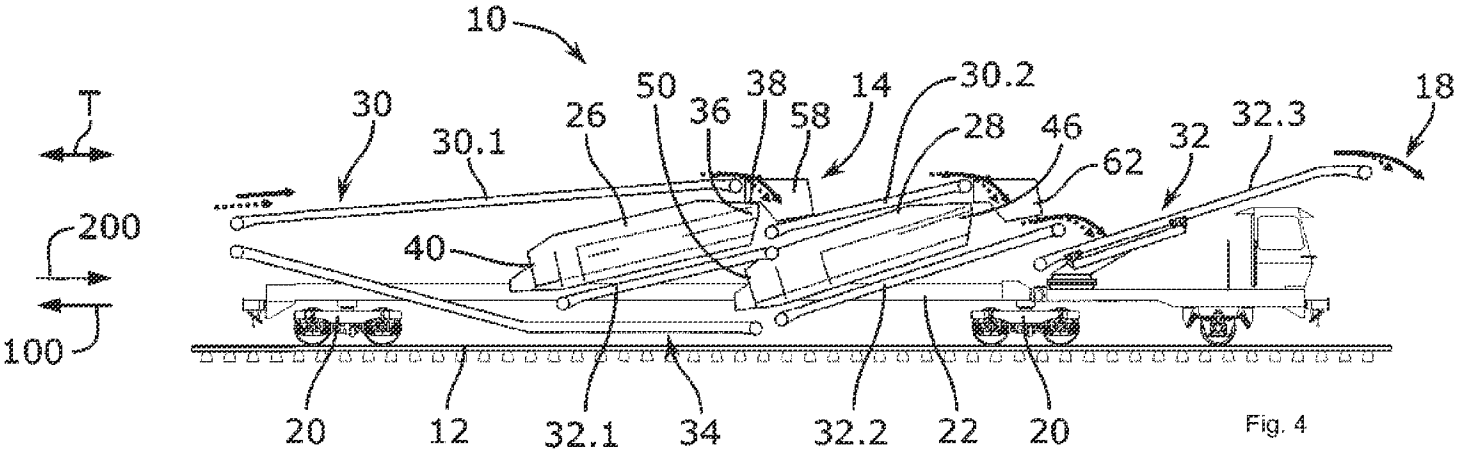
FIG. 4, the railway works vehicle of FIG. 1, the sieving installation of which operates in a mode where neither of the two sieves is in operation.

In FIG. 4, the first distributor 58 is illustrated in another orientation operating mode and the flow of soiled ballast is directed entirely toward the intermediate conveyor 30.2, which conveys the entire flow of soiled ballast toward the second distributor 62, while the first sieve is inoperative. The second distributor 62 is in a second orientation operating mode and the flow of soiled ballast is entirely collected by the set of one or more discharge conveyors 32, which works in the same direction as the excavation conveyor 30, that is to say, in the second direction 200, and is conveyed toward the storage assembly 18. The second sieve 28 is inoperative.

The sieving installation according to the invention therefore makes it possible to carry out total excavation operations without sieving, that is to say, without going through either of the two sieves 26, 28.

Other operating modes are also possible. In particular, it is possible to operate the first distributor 58 in the distribution operating mode (as illustrated in FIG. 1), in order to distribute the flow of soiled ballast between the first sieve 26 and the intermediate conveyor 30.2, and to operate the second distributor 62 in the orientation operating mode of FIG. 4, in order to direct the flow of soiled ballast from the intermediate conveyor 30.2 toward the set of one or more discharge conveyors 32 and toward the storage assembly 18.

Insofar as the distributors 58, 62 allow continuous adjustment, all variations around the operating modes described above are authorized.

Naturally, the example shown in the figures and discussed above is given only by way of illustration. Various variants are possible.

In the event that the second sieve does not have a discarded ballast inlet 56, the discarded ballast from the first sieve 26 can be discharged directly by the intermediate discharge conveyor 32.1 onto the common discharge conveyor 32.2.

The second distributor 62 can be arranged to discharge the flow of ballast directly onto the conveyor 32.3 rather than onto the conveyor 32.2.

Each of the conveyors 30.1, 30.2, 32.1, 32.2, 32.3, 34 may, where appropriate, consist of several independent sections or conveyors. Regarding the rerouting conveyor 34 in particular, it is possible to provide a relatively narrow section running from the second clean ballast outlet 54 to the first clean ballast outlet 54 under the first sieve 26, and discharging into a second, wider section, therefore of higher capacity, also collecting the flow of clean ballast flow from the first clean ballast outlet 44. This makes it possible, where appropriate, to facilitate the positioning of the conveyors in the limited space available under the first sieve 26.

It is conceivable to reinforce the sieving capacity of the installation with at least one intermediate sieve, positioned between the first sieve and the second sieve. The intermediate sieve is associated with an intermediate distributor capable of distributing the incident flow of soiled ballast (coming from the first distributor) between the intermediate sieve and the second distributor. The flow of discarded ballast from the first sieve is collected by the intermediate conveyor and discharged into the intermediate sieve, at the outlet end and above the outlet of the discarded ballast flow from the intermediate sieve. The discarded ballast flows from the first sieve and the intermediate sieve are collected by a second intermediate conveyor and discharged into the second sieve, at the outlet end and above the outlet of the discarded ballast flow from the second sieve. The discarded ballast flows from the first sieve, the intermediate sieve and the second sieve are collected by the set of one or more discharge conveyors that work in the same direction as the excavation conveyor, that is to say, in the second direction, toward the storage assembly.

The set of one or more rerouting conveyors works in the first direction, collects the clean ballast flow at the clean ballast outlet of the second sieve, then collects the clean ballast flow at the clean ballast outlet of the intermediate sieve, then collects the clean ballast flow at the clean ballast outlet of the first sieve, and thus conveys a single clean ballast flow to the relining assembly.

The sieving installation according to this variant of the invention makes it possible to multiply the operating methods by using one, two or three sieves in parallel while keeping the possibility of carrying out total excavation operations, without sieving, that is to say, without going through any of the three sieves.

Of course, other variants are possible. A mobile system borne by a single car has been described. This arrangement is not, however, limiting, and it is possible to envisage more generally that the mobile system is carried by one or more railway, motorized or towed vehicles.

The invention claimed is:

1. A ballast sieving system capable of moving parallel to a working direction, comprising a sieving installation comprising at least a first sieve having a first soiled ballast inlet, a first clean ballast outlet which is located in front of the first soiled ballast inlet in a first direction parallel to a working direction and a first discarded ballast outlet, and at least one second sieve having a second soiled ballast inlet which is located behind the first soiled ballast inlet in the first direction, a second clean ballast outlet which is located behind the first clean ballast outlet and in front of the second soiled ballast inlet in the first direction and a second discarded ballast outlet, a set of one or more rerouting conveyors capable of collecting and conveying, in the first direction, a flow leaving the second clean ballast outlet and a flow leaving the first clean ballast outlet, the set of one or more rerouting conveyors comprising one or more rerouting collection conveyors for directly collecting the flow leaving the second clean ballast outlet and conveying it in the first direction, the one or more rerouting collection conveyors comprising at least one common rerouting conveyor capable of conveying both the flow of clean ballast from the second clean ballast outlet and the flow of clean ballast from the first clean ballast outlet, in the first direction, at least part of the common rerouting conveyor being positioned under the first sieve, a set of one or more discharge conveyors capable of collecting and conveying, in a second direction parallel to the working direction and opposite the first direction, a flow of discarded ballast from the first discarded ballast outlet and a flow of discarded ballast from the second discarded ballast outlet, the set of one or more discharge conveyors comprising one or more first discharge collection conveyors, located directly below the first discarded ballast outlet to collect a flow of discarded ballast from the first sieve and to convey it in the second direction, wherein the one or more rerouting collection conveyors extend under the first sieve at a lower height than the first discharge collection conveyor(s), and the second sieve comprises a discarded ballast inlet suitable for being supplied by the first discharge collection conveyor(s), and a spout for passing the flow of discarded ballast coming from the first sieve from the discarded ballast inlet to the second discarded ballast outlet.

2. The ballast sieving system of claim 1, wherein the discarded ballast inlet of the second sieve is positioned above the second clean ballast outlet.

3. The ballast sieving system of claim 1, wherein the second sieve and the first sieve overlap.

4. The ballast sieving system of claim 1, further comprising an assembly for relining or storing clean ballast, supplied by the set of one or more rerouting conveyors, the assembly for relining or storing clean ballast being positioned in front of the first soiled ballast inlet, and in front of the first sieve, in the first direction.

5. The ballast sieving system of claim 1, further comprising a discarded ballast storage assembly, the set of one or more discharge conveyors comprising at least one common discharge conveyor capable of conveying both the flow of discarded ballast from the first discarded ballast outlet and the flow of discarded ballast from the second discarded ballast outlet to the discarded ballast storage assembly, in the second direction, at least part of the common discharge conveyor being positioned under the second sieve.

6. The ballast sieving system of claim 5, wherein the assembly for relining or for storing clean ballast is positioned between an excavation assembly and the first soiled ballast inlet, and between the excavation assembly and the first sieve.

7. A ballast sieving system capable of moving parallel to a working direction, comprising:

a sieving installation comprising at least a first sieve having a first soiled ballast inlet, a first clean ballast outlet which is located in front of the first soiled ballast inlet in a first direction parallel to the working direction and a first discarded ballast outlet, and at least one second sieve having a second soiled ballast inlet which is located behind the first soiled ballast inlet in the first direction, a second clean ballast outlet which is located behind the first clean ballast outlet and in front of the second soiled ballast inlet in the first direction and a second discarded ballast outlet, a set of one or more rerouting conveyors capable of collecting and conveying, in the first direction, a flow leaving the second clean ballast outlet and a flow leaving the first clean ballast outlet, the set of one or more rerouting conveyors comprising one or more rerouting collection conveyors for directly collecting the flow leaving the second clean ballast outlet and conveying it in the first direction, a set of one or more discharge conveyors capable of collecting and conveying, in a second direction parallel to the working direction and opposite the first direction, a flow of discarded ballast from the first discarded ballast outlet and a flow of discarded ballast from the second discarded ballast outlet, the set of one or more discharge conveyors comprising one or more first discharge collection conveyors, located directly below the first discarded ballast outlet to collect a flow of discarded ballast from the first sieve and to convey it in the second direction, an excavation assembly, and a set of one or more excavation conveyors, capable of transferring soiled ballast from the excavation assembly to a first distributor while constituting an incident soiled ballast flow, wherein the one or more rerouting collection conveyors extend under the first sieve at a lower height than the first discharge collection conveyor(s), and the second sieve comprises a discarded ballast inlet suitable for being supplied by the first discharge collection conveyor(s), and a spout for passing the flow of discarded ballast coming from the first sieve from the discarded ballast inlet to the second discarded ballast outlet, and the first soiled ballast inlet is positioned between the excavation assembly and the second soiled ballast inlet, and the first sieve is positioned between the excavation assembly and the second soiled ballast inlet.

8. The ballast sieving system of claim 7, wherein the discarded ballast inlet of the second sieve is positioned above the second clean ballast outlet.

9. The ballast sieving system of claim 7, wherein the second sieve and the first sieve overlap.

10. The ballast sieving system of claim 7, wherein the set of one or more rerouting conveyors comprises at least one common rerouting conveyor capable of conveying both the flow of clean ballast from the second clean ballast outlet and the flow of clean ballast from the first clean ballast outlet, in the first direction, at least part of the common rerouting conveyor preferably being positioned under the first sieve.

11. The ballast sieving system of claim 7, further comprising an assembly for relining or storing clean ballast, supplied by the set of one or more rerouting conveyors, the assembly for relining or storing clean ballast being positioned in front of the first soiled ballast inlet, and in front of the first sieve, in the first direction.

12. The ballast sieving system of claim 7, further comprising a discarded ballast storage assembly, the set of one or more discharge conveyors comprising at least one common discharge conveyor capable of conveying both the flow of discarded ballast from the first discarded ballast outlet and the flow of discarded ballast from the second discarded ballast outlet to the discarded ballast storage assembly, in the second direction, at least part of the common discharge conveyor being positioned under the second sieve.

13. The ballast sieving system of claim 7, further comprising at least one first distributor, able to distribute an incident soiled ballast flow between the first soiled ballast inlet and the second soiled ballast inlet, according to one, two or three of the following operating modes:

a distribution operating mode, in which the first distributor is able to distribute the incident soiled ballast flow between the first soiled ballast inlet and the second soiled ballast inlet;

a return operating mode to the second sieve, in which the first distributor is able to direct the incident soiled ballast flow entirely toward the second soiled ballast inlet;

a return operating mode to the first sieve, in which the first distributor is able to direct the incident soiled ballast flow entirely toward the first soiled ballast inlet.

14. A ballast sieving system capable of moving parallel to a working direction, comprising a sieving installation comprising at least a first sieve having a first soiled ballast inlet, a first clean ballast outlet which is located in front of the first soiled ballast inlet in a first direction parallel to the working direction and a first discarded ballast outlet, and at least one second sieve having a second soiled ballast inlet which is located behind the first soiled ballast inlet in the first direction, a second clean ballast outlet which is located behind the first clean ballast outlet and in front of the second soiled ballast inlet in the first direction and a second discarded ballast outlet, a set of one or more rerouting conveyors capable of collecting and conveying, in the first direction, a flow leaving the second clean ballast outlet and a flow leaving the first clean ballast outlet, the set of one or more rerouting conveyors comprising one or more rerouting collection conveyors for directly collecting the flow leaving the second clean ballast outlet and conveying it in the first direction, a set of one or more discharge conveyors capable of collecting and conveying, in a second direction parallel to the working direction and opposite the first direction, a flow of discarded ballast from the first discarded ballast outlet and a flow of discarded ballast from the second discarded ballast outlet, the set of one or more discharge conveyors comprising one or more first discharge collection conveyors, located directly below the first discarded ballast outlet to collect a flow of discarded ballast from the first sieve and to convey it in the second direction, at least one first distributor, wherein the one or more rerouting collection conveyors extend under the first sieve at a lower height than the first discharge collection conveyor(s), and the second sieve comprises a discarded ballast inlet suitable for being supplied by the first discharge collection conveyor(s), and a spout for passing the flow of discarded ballast coming from the first sieve from the discarded ballast inlet to the second discarded ballast outlet, and the first distributor is able to distribute an incident soiled ballast flow between the first soiled ballast inlet and the second soiled ballast inlet, according to one, two or three of the following operating modes:

a distribution operating mode, in which the first distributor is able to distribute the incident soiled ballast flow between the first soiled ballast inlet and the second soiled ballast inlet;

a return operating mode to the second sieve, in which the first distributor is able to direct the incident soiled ballast flow entirely toward the second soiled ballast inlet;

a return operating mode to the first sieve, in which the first distributor is able to direct the incident soiled ballast flow entirely toward the first soiled ballast inlet.

15. The ballast sieving system of claim 14, wherein the discarded ballast inlet of the second sieve is positioned above the second clean ballast outlet.

16. The ballast sieving system of claim 14, wherein the second sieve and the first sieve overlap.

17. The ballast sieving system of claim 14, wherein the set of one or more rerouting conveyors comprises at least one common rerouting conveyor capable of conveying both the flow of clean ballast from the second clean ballast outlet and the flow of clean ballast from the first clean ballast outlet, in the first direction, at least part of the common rerouting conveyor preferably being positioned under the first sieve.

18. The ballast sieving system of claim 14, further comprising an assembly for relining or storing clean ballast, supplied by the set of one or more rerouting conveyors, the assembly for relining or storing clean ballast being positioned in front of the first soiled ballast inlet, and in front of the first sieve, in the first direction.

19. The ballast sieving system of claim 14, further comprising a discarded ballast storage assembly, the set of one or more discharge conveyors comprising at least one common discharge conveyor capable of conveying both the flow of discarded ballast from the first discarded ballast outlet and the flow of discarded ballast from the second discarded ballast outlet to the discarded ballast storage assembly, in the second direction, at least part of the common discharge conveyor being positioned under the second sieve.

20. The ballast sieving system of claim 14, further comprising a second distributor interposed between the first distributor and the second soiled ballast inlet that is capable, in at least one operating mode of the second distributor, of directing a flow of soiled ballast coming from the first distributor toward the second soiled ballast inlet and, in a second operating mode of the second distributor, of directing the flow of soiled ballast from the first distributor toward a conveyor of the set of one or more discharge conveyors.

* * * * *